US006834398B1

(12) United States Patent
Martinez

(10) Patent No.: US 6,834,398 B1
(45) Date of Patent: Dec. 28, 2004

(54) HELMET

(76) Inventor: Randy Martinez, 2214 S. Saranac, Mesa, AZ (US) 85208

( * ) Notice: Subject to any disclaimer, the term of this patent is extended or adjusted under 35 U.S.C. 154(b) by 0 days.

(21) Appl. No.: 10/723,885

(22) Filed: Nov. 26, 2003

(51) Int. Cl.[7] ..... A42B 1/08
(52) U.S. Cl. ..... 2/424; 2/6.6; 2/909
(58) Field of Search ..... 2/424, 425, 410, 2/6.6, 6.1, 909

(56) References Cited

U.S. PATENT DOCUMENTS

| | | | | |
|---|---|---|---|---|
| 4,689,836 A | | 9/1987 | Vitaloni | |
| 4,769,857 A | | 9/1988 | Cianfanelli et al. | |
| 4,817,596 A | * | 4/1989 | Gallet | 128/201.24 |
| 5,084,918 A | | 2/1992 | Breining et al. | |
| 5,093,939 A | | 3/1992 | Noyerie et al. | |
| 5,105,475 A | * | 4/1992 | Lynd et al. | 2/10 |
| 5,412,810 A | | 5/1995 | Taniuchi | |
| 6,212,689 B1 | | 4/2001 | Lee | |
| 6,226,803 B1 | | 5/2001 | Tanaka | |
| 6,237,161 B1 | | 5/2001 | Lee | |
| 6,606,751 B1 | * | 8/2003 | Kalhok et al. | 2/424 |
| 2001/0054188 A1 | * | 12/2001 | Guay et al. | 2/6.4 |
| 2002/0104533 A1 | | 8/2002 | Kalhok et al. | |
| 2002/0129440 A1 | | 9/2002 | Hong et al. | |
| 2003/0070200 A1 | | 4/2003 | Crye et al. | |

* cited by examiner

*Primary Examiner*—Rodney M. Lindsey
(74) *Attorney, Agent, or Firm*—Parsons & Goltry; Michael W. Goltry; Robert A. Parsons

(57) ABSTRACT

A helmet, sized and shaped to receive the head of a wearer, includes a ballistic shield that is pivotally movable between a raised position for spanning and protecting the frontal area of the face of the wearer and a lowered position for spanning and protecting the mandibular area of the face of the wearer. Detent means interacting between the helmet and the shield releasably retain the ballistic shield in the lowered position and in the raised position.

8 Claims, 6 Drawing Sheets

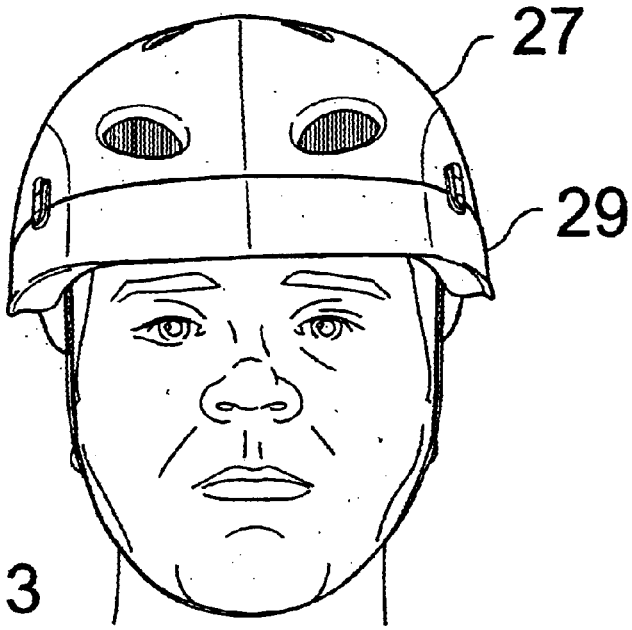
FIGURE 3
FIGURE 4
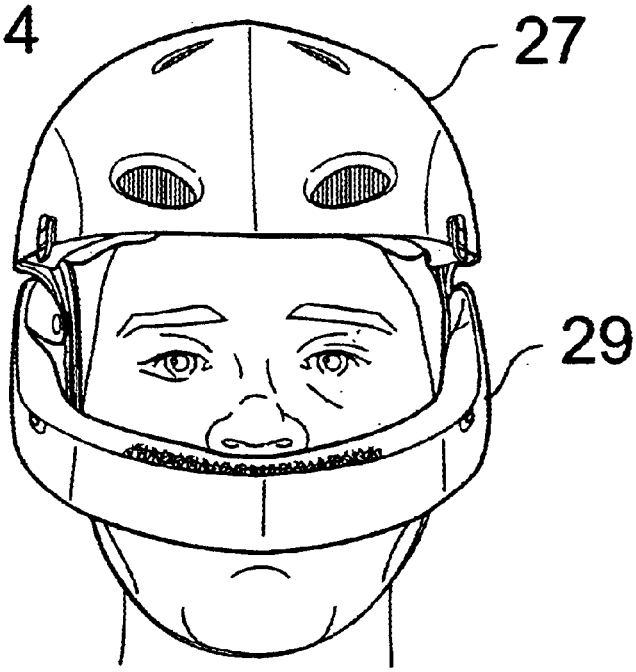

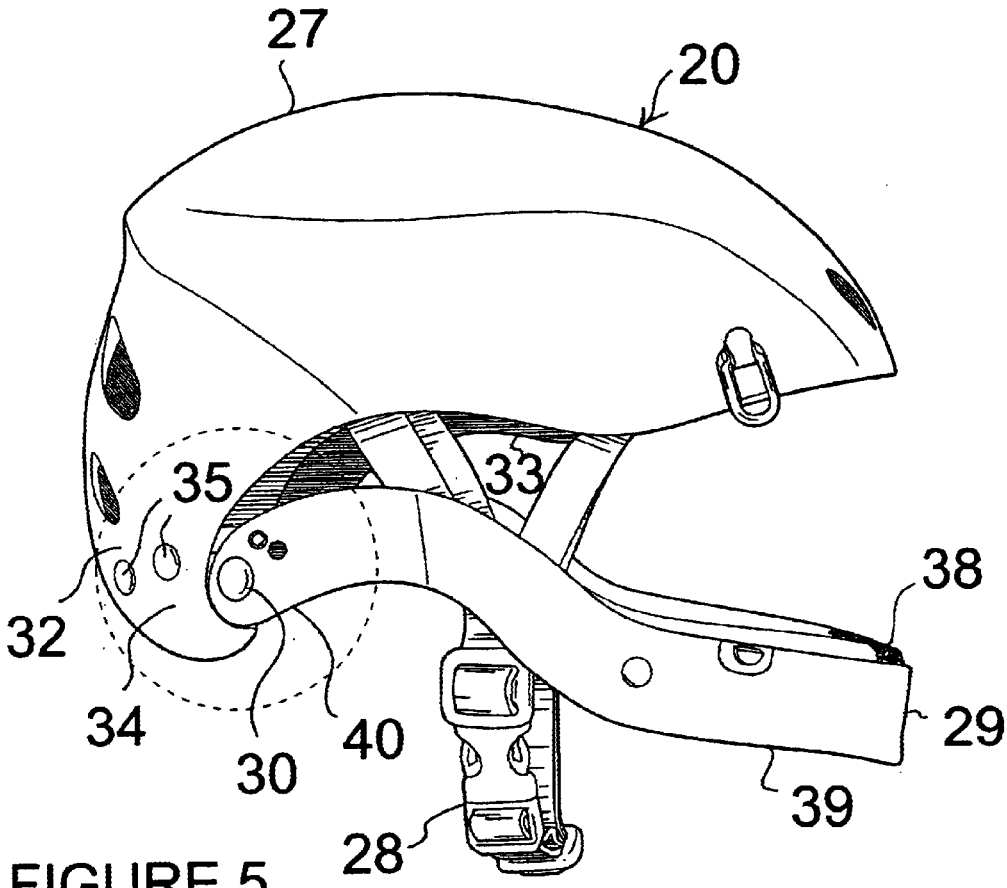
FIGURE 5
FIGURE 6
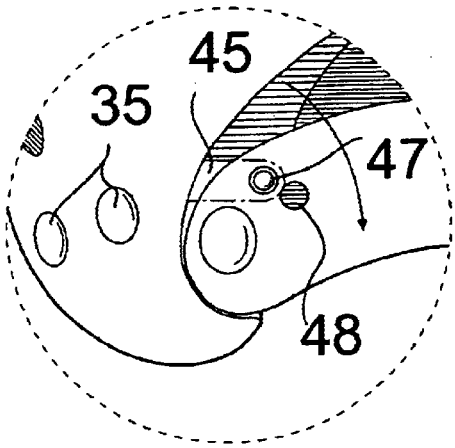
FIGURE 7
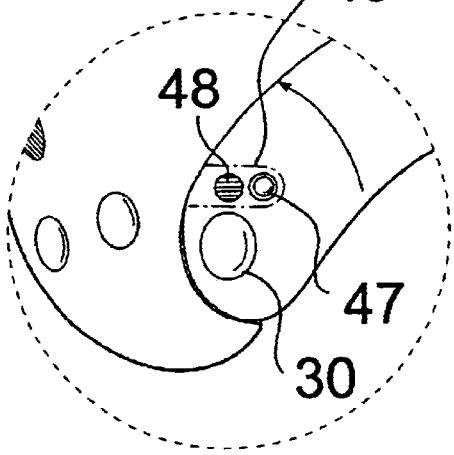

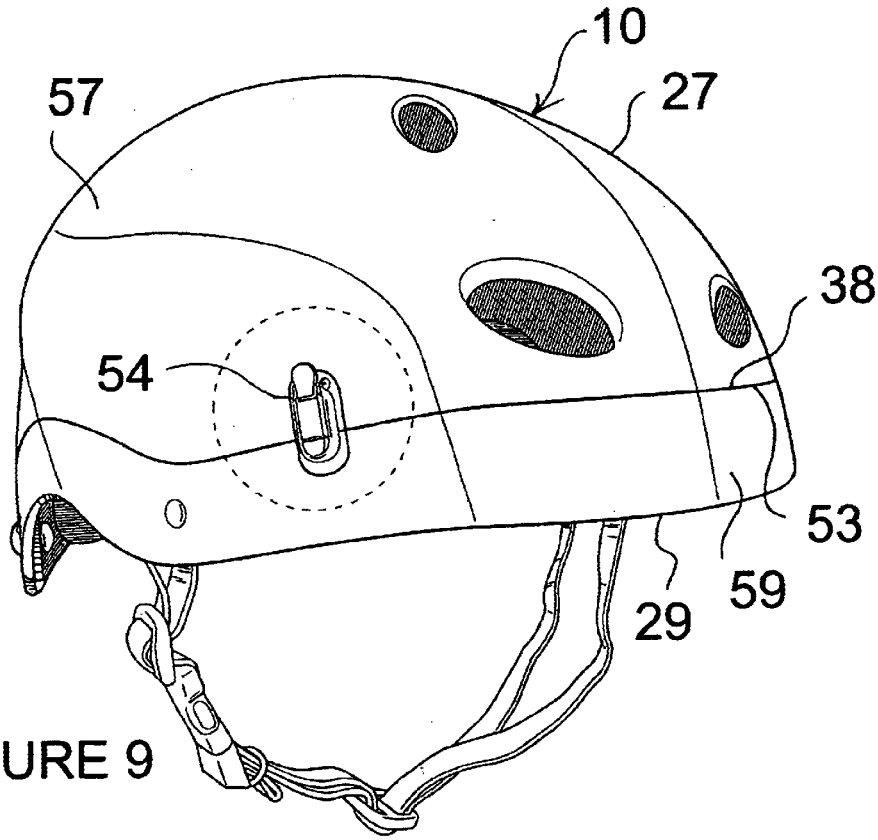
FIGURE 9
FIGURE 10
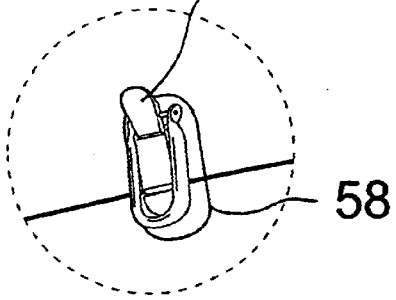
FIGURE 11
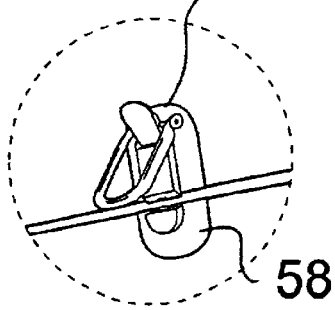

HELMET

FIELD OF THE INVENTION

The present invention relates to protective headgear.

BACKGROUND OF THE INVENTION

The prior art is replete with helmets, which are worn as protective headgear during the operation of a vehicle. In general, helmets are of two basic types. One type, commonly referred to as "jet-type", covers the head of the wearer while exposing the face of the wearer. The other type, conventionally referred to as "full face", includes a chin shield for protecting the lower portion of the face of the wearer.

Two species of full-face helmets are known. In accordance with one species, the chin shield is integrally formed with the head protecting body or shell. In the other species, the chin shield is mounted upon the shell for vertical movement between a lowered position and a raised position. In the lowered position, the chin shield extends across the mandibular portion of the face. In the raised position, the chin shield resides above and straddling the shell.

The latter specie of full-face helmet actually performs as a full-face helmet when the chin shield is in the lowered position and as a jet-type helmet when the chin shield is in the raised position. A dual-purpose helmet that selectively functions as a full-face helmet or a jet-type helmet is highly desirable. For example, many vehicles, such as bicycles and skateboards, are ridden for pleasure in minimal risk environments. During such operation a jet-type helmet is desirable; the chin shield in the lowered position being considered an inconvenience and unwanted obstruction. When vehicles are ridden in perilous environments or in competition, the chin shield is highly desirable.

The prior art has provided numerous specific configurations of dual-purpose helmets. None, however, have proven to be entirely satisfactory. Many incorporate substantially complex and relatively expensive mechanisms for raising and lowering the chin shield. Frequently, the prior art dual-purpose helmets are inconvenient to operate, requiring a precise sequence of operations by the wearer, which may require removal of the helmet. It is also noted, that when in the raised position, the chin shield has no protective value. Further, the chin shield, in the raised position, resides above the shell thereby providing an obstruction to the normally smooth surface of the shell that can be snagged with attendant injury to the head and neck area of the wearer.

SUMMARY OF THE INVENTION

It would be highly advantageous, therefore, to remedy the foregoing and other deficiencies inherent in the prior art.

Accordingly, it is an object of the instant invention to provide a helmet having improved means for selectively functioning as a jet-type helmet or a full-face type helmet.

Another object of the present invention is the provision of a protective helmet having simplified means for moving the chin shield between the raised position and the lowered position.

And another object of this invention is to provide a helmet in which the chin shield can be readily manipulated with one hand of the wearer without removal from the head.

Still another object of the invention is the provision of a helmet having a movable chin guard that can be raised or lowered in a single step.

Yet another object of the present invention is to provide a full-face helmet in which the chin guard performs a protective function in the raised position and in the lowered position.

Yet still another object of the instant invention is the provision of a helmet having a movable shield having an outer surface, which in the raised position is integral with the helmet shell.

A further object of this invention is to provide a helmet having a movable shield that, in the raised position, leaves the outer surface of the shell unobstructed.

A yet further object of the present invention is the provision of a helmet having a single means for holding the shield in the raised position and in the lowered position.

A still further object of this invention is to provide a helmet having a movable shield that can be simply and inexpensively manufactured with conventional helmet manufacturing methods.

A yet still further object of the invention is the provision of a movable shield that can be incorporated into a conventional jet-type helmet.

Briefly, to achieve the objects and advantages of the instant invention, in accordance with a preferred embodiment thereof, first provided is a protective helmet having a shell for receiving the head of a wearer and exposing the face, including the frontal area and the mandibular area of the face. The shell is constructed in accordance with conventional practice and standard manufacturing techniques.

The improvements of present invention include a shield is attached to the shell for movement between a raised position in which the shield spans the frontal area of the face and a lowered position in which the shield spans the mandibular area of the face.

It is within the teachings of the invention that the shell and the shield include outer surfaces that are substantially contiguous when the shield is in the raised position. Preferably, when in the raised position, the upper terminal edge of the shield abuts the forward terminal edge of the shield. Detent means retain the shield in the lowered position and in the lowered position. The detent means may be in the form of a ball component and a strike component, one of the components being carried by the shield and the other of the components being carried by the shell. The detent may also include a hook and loop fastener; one of the elements being affixed to the upper terminal edge of the shield and the other of the elements be affixed to the forward terminal edge of the shell.

It is also within the scope of the invention that the shield include opposed, depending lateral sides which are pivotally connected to respective terminal ends of the shield. Latch means can be provided to releasably retain the shield in the raised position. A preferred latch means is in the form of interlocking engagement pair having a catch element and a strike element, one of the elements being carried by the shell and the other of the elements being carried by the shield.

In accordance with a preferred method of fabricating the helmet, a shell having an integral anterior portion is formed in accordance with conventional practice and using known materials. After the shell is formed, the anterior portion is separated and subsequently joined to the shell for movement between a raised position and a lowered position. It is within the scope of the method that the shield be pivotally attached to the shell. Detent means may be provided for releasably retaining the shield in the raised position and in the lowered position.

It is completed that the upper edge of the shield abut the forward terminal edge of the shell when in the raised position. Preferably, when the shield is in the raised position, the outer surface of the shield is substantially contiguous with the outer surface of the shell. An engagement pair, one element of which is affixed proximate the upper edge of the shield and a complemental of which is affixed proximate the forward terminal edge of the shell functions to releasably retain the shield in the raised position.

BRIEF DESCRIPTION OF THE DRAWINGS

Referring to the drawings:

FIG. 3 is a front view taken from the view of FIG. 1;

FIG. 4 is a front view taken from the view of FIG. 2;

FIG. 5 is a side elevational view of the helmet as seen in FIG. 2; a portion thereof being broken away for purposes of illustration;

FIG. 6 is an enlarged fragmentary view taken from FIG. 5 and especially detailing the connection between the helmet shell and the ballistic shield, the ballistic shield being in the lowered position;

FIG. 7 is a view generally corresponding to the view of FIG. 6, the ballistic shield being in the raised position;

FIG. 9 is a view generally corresponding to the view of FIG. 1, and having latch means being shown in the engaged position;

FIG. 10 is an enlarged fragmentary view taken from the view of FIG. 9 and especially detailing a latch means useful in connection with the helmet of the present invention, the latch being in the engaged position; and FIG. 11 is a view generally corresponding to the view of FIG. 10, the latch means being in the disengaged position.

DETAILED DESCRIPTION OF A PREFERRED EMBODIMENT

Figure 1:
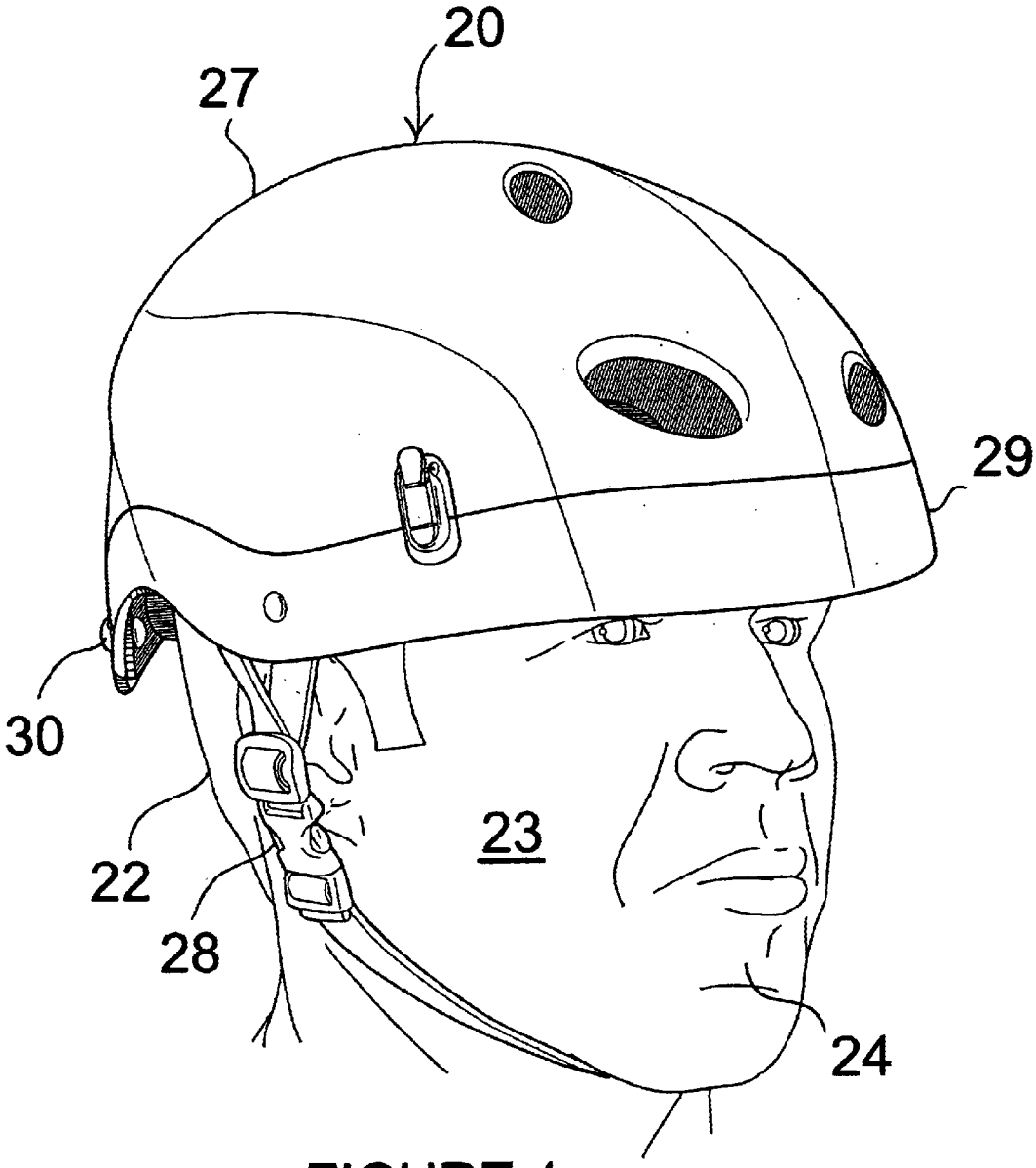
FIG. 1 is a perspective view of a protective helmet, constructed in accordance with the principles of the instant invention, as it would appear upon the head of a wearer, the helmet having a movable ballistic shield being in a raised position.

Turing now to the drawings, in which like reference character indicate corresponding elements throughout the several views, attention is first directed to FIG. 1, is which is seen a helmet, embodying the principles of the instant invention and generally designated by the reference character 20, as it would appear when upon the head of a wearer, generally designated by the reference character 22.

Figure 2:
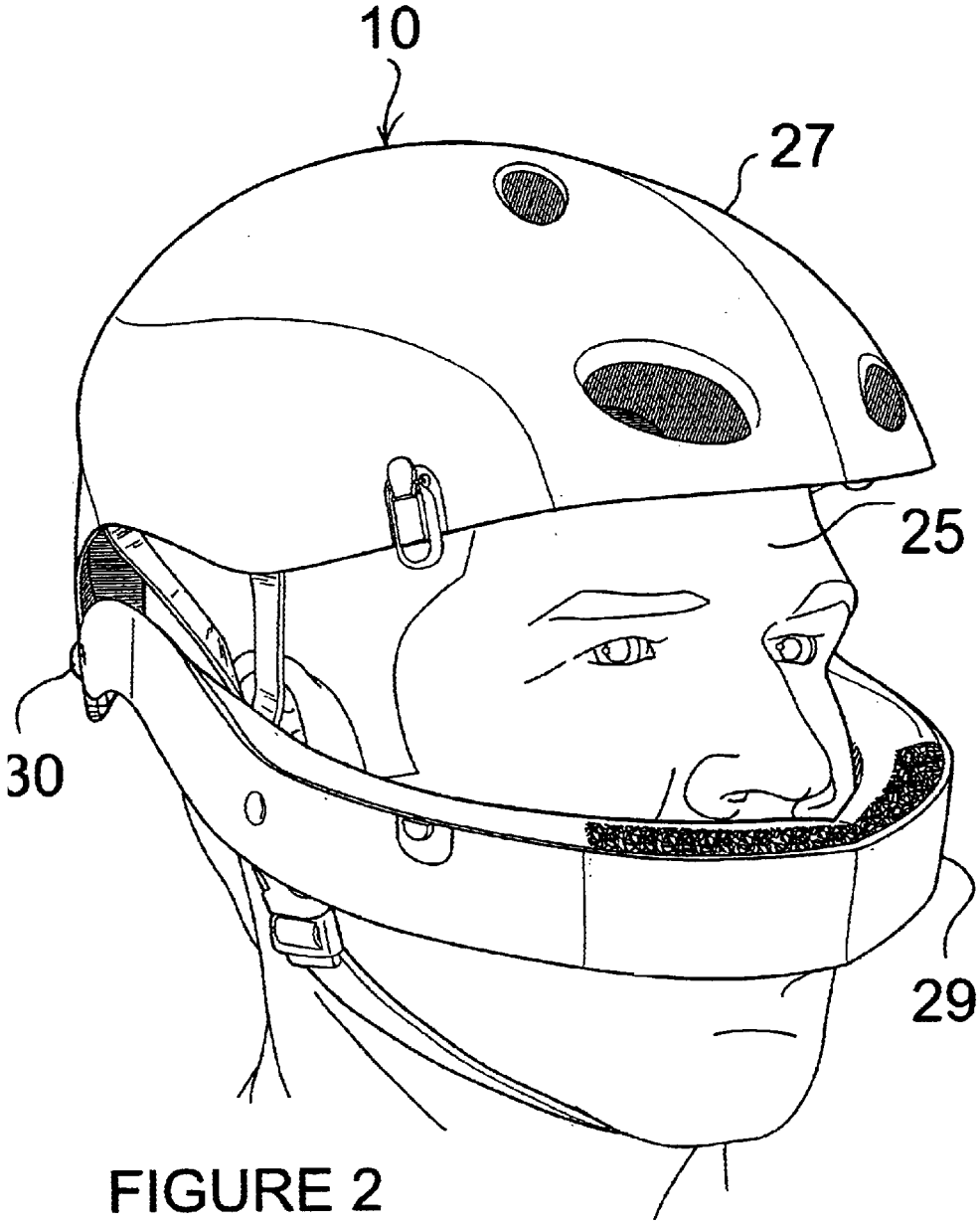
FIG. 2 is a view generally similar to the view of FIG. 1, the ballistic shield being in the lowered position.

For purposes of reference and understanding, head 22 includes face 23 having mandibular area 24 and frontal area 25, the latter being better seen in FIG. 2. Frontal area 25 is commonly referred to as the forehead, while mandibular area 24 generally refers to the mouth and lower jaw area of the face.

Helmet 20 includes shell 27 which may be constructed of conventional materials and utilizing methods standard within the art. One such method includes fabricating the helmet of layers of fabric impregnated with phenolic resin such as that sold under the trademark Kevlar® or Nomex®. The several layers are laminated together with a laminating resin such as a catalyzed system of 50% phenol formaldehyde and 50% butyral resins. Subsequently, the shell is lined with an inner pad assembly, such as foam rubber or plastic, which is overlain with leather or leather substitute. The shell with lining is sized and shaped to receive the head the user. The helmet is held in place upon the head by a conventional shin strap 28.

In accordance with the teachings of the instant invention, a ballistic shield 29 is secured to shell 27 as by as by rivets 30 for pivotal movement between a raised position for spanning and protecting the frontal area 25 as seen in FIGS. 1 and 3 and a lowered position for spanning and protecting the mandibular area 24 as seen in FIGS. 2 and 4. It is contemplated that ballistic shield 29 is molded or fabricated with conventional materials in accordance with standard methods as set forth above.

Turning now to FIG. 5, in which it is seen that shell 27 includes first and second spaced apart lateral sides 32 and 33, respectively. Second lateral side 33 is better seen in FIG. 8. A plate 34 is affixed to the interior of lateral side 32 as by rivets 35 to project forwardly therefrom. A mirror image plate 37 is similarly affixed to the interior of lateral side 33. It is understood that the plates 34 and 37 may be affixed to the respective lateral sides in accordance with other methods known to those skilled in the art, such as gluing.

Figure 8:
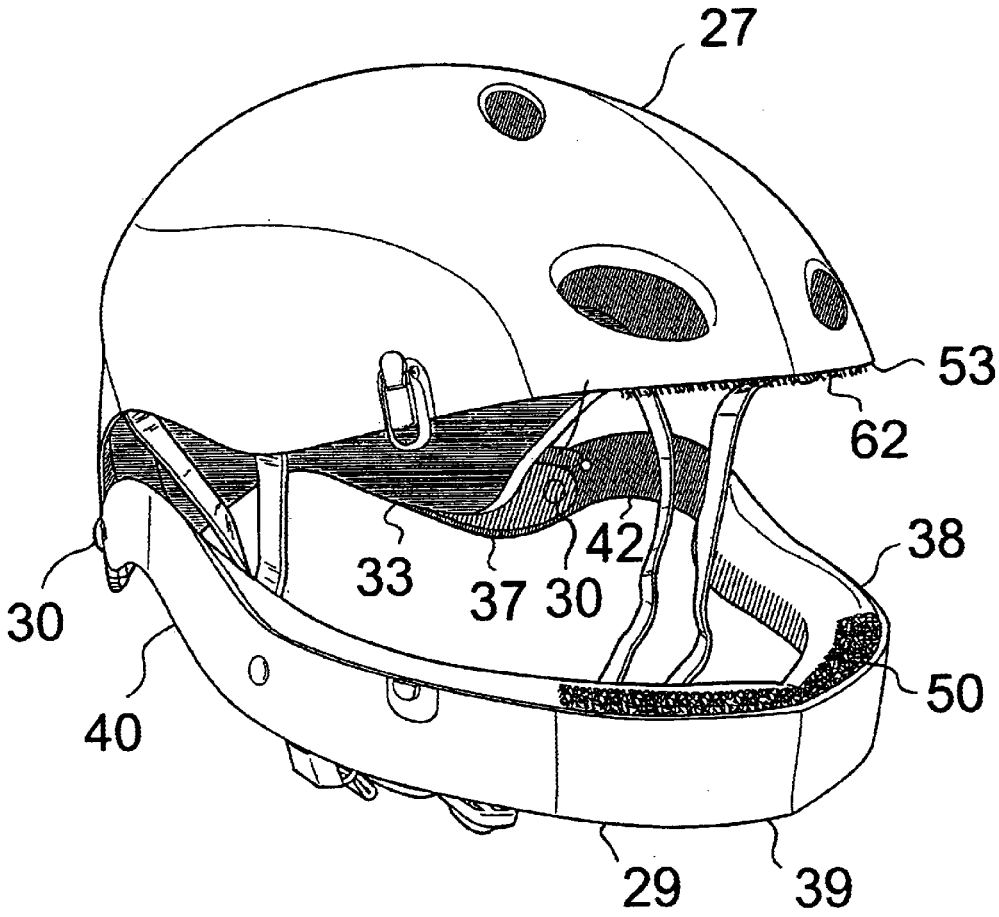
FIG. 8 is a perspective view of the helmet seen in FIG. 2.

With further reference to FIGS. 5 and 8, it is seen that ballistic shield 29 is generally "U" shaped having upper edge 38, lower edge 39 and first and second terminal ends 40 and 42, respectively. First terminal end 40 is pivotally connected to plate 34 as by a rivet 30. Second terminal end 42 is similarly pivotally connected to plate 37 as by a rivet 30. Other means for effecting a pivotal attachment between ballistic shield 29 and shell 27, such as a hinge or ball and socket joint, will readily occur to those skilled in the art.

It is within the scope of the present invention to provide detent means for alternately retaining the ballistic shield in the raised position and in the lowered position. In accordance embodiment thereof, the detent means includes a ball element and a strike element. Referring specifically to FIGS. 5, 6 and 7 there is seen a tab 45 secured to inner lateral side 32 and projecting forwardly therefrom. Tab 45 is secured as by glue or other conventional means. One element 47 of the detent means is carried by the tab, while the other element 48 is carried by the ballistic shield. Tab 45 is sufficiently resilient that the element 48 can pass to either side of element 47. With specific reference to FIG. 8, it is seen that mirror image detent means 49 is carried at the second lateral side 33.

With additional reference to FIG. 8, there is seen an alternate detent means for retaining ballistic shield 29 in the raised position. The immediate embodiment of the detent means is in the form of a hook and loop fastener, such as the one sold under the trademark Velcro®. One element 50 of the hook and loop fastener is secured to the upper edge 38 of ballistic shield 29. The other element 52 of the hook and loop fastener is secured to the forward edge 53 of shell 27.

Other detent means, which can be readily manipulated by one hand without removal of the helmet from the head, will readily occur to those skilled in the art.

Attention is now directed to FIG. 9, in which is seen a latch assembly 54 for releasably securing ballistic shield in the raised position. Chosen for purposes of illustration, as seen in greater detail in FIGS. 10 and 11, latch assembly 54 is in the form of a draw bolt mechanism having a catch 55 secured to outer surface 57 of shell 27. The other element of the draw bolt assembly, strike 58, is secured to the outer surface 59 of ballistic shield 29.

As particularly illustrated in FIG. 9, upper edge 38 of ballistic shield 29 abuts forward edge 53 of shell 27 when in the raised position. Also when in the raised position, outer surface 59 of shield 29 is substantially contiguous with outer surface 57 of shell 27.

It is within the teachings of the instant invention that shell 27 and ballistic shield 29 be integrally molded or otherwise formed as a single unit. As such, the shield is an integral anterior terminal portion of the shell. After fabrication, the anterior terminal portion is separated, as by cutting or sawing, to form a forward edge 53 on shell 27 and an upper edge 38 of the ballistic shield 29. Subsequently, shell 27 and ballistic shield 29 are joined as previously described and illustrated in connection with FIGS. 5, 6 and 7. The shell and the shield are padded and lined in accordance with conventional practice. Detent means and latch means, as previously illustrated and described, may be incorporated into the foregoing method of fabrication.

Various modifications and variations to the embodiments herein chosen for illustration will readily occur to those skilled in the art. For example, while the foregoing disclosure is directed to a protective helmet that can be optionally used either as a jet-type helmet or a full-face helmet, the teaching can be practiced to convert a preexisting jet type helmet into a full-face helmet. To the extent that such modifications and variations do not depart spirit of the invention, they are intended to be included with the scope thereof.

Having fully described the invention is such clear and concise terms as to enable those skilled in the art to understand and practice the same, the invention claimed is:

What is claimed is:

1. In a protective helmet having a shell for receiving a head of a wearer, the head including a face having a frontal area and a mandibular area, improvements therein comprising:

a ballistic shield carried by the shell and movable between a raised position in which the shield spans the frontal area of the face and a lowered position in which the shield spans the mandibular area of the face; and latch means for releasably securing the shield to the shell when the shield is in the raised position, the latch means including a hook and loop fastener having an element thereof carried at a terminal edge of the shell and a complemental element thereof carried at a terminal edge of the shield.

2. The improvements of claim 1, wherein the shell includes an outer surface and therein the ballistic shield includes an outer surface, the outer surface of the shield being substantially contiguous with the outer surface of the shell when the ballistic shield is in the raised position.

3. The improvements of claim 1, wherein the shell includes a forward terminal edge extending laterally of the face proximate the frontal area and the shield includes a laterally extending upper terminal edge, and wherein the terminal edge of the shield abuts the terminal edge of the shell when the shield is in the raised position.

4. The improvements of claim 1, wherein the shell includes first and second opposed lateral sides and the shield includes first and second terminal ends, the terminal ends being pivotally secured to respective lateral sides of the shell.

5. The improvements of claim 1, further including detent means for alternately retaining the shield in the raised position and in the lowered position.

6. The improvements of claim 5, wherein the detent means includes a ball component and a strike component, one of the components being carried by the shell and the other of the components being carried by the shield.

7. The improvements of claim 3, further including detent means for releasably retaining the shield in the raised position.

8. The improvements of claim 1, further comprising a catch element and a strike element for releasably securing the shield to the shell when the shield is in the raised position, one of the elements being carried by the shell, the other of the elements being carried by the shield.

* * * * *